US005171658A

United States Patent [19]

Fyson

[11] Patent Number: 5,171,658

[45] Date of Patent: Dec. 15, 1992

[54] METHOD OF PHOTOGRAPHIC PROCESSING

[75] Inventor: John R. Fyson, Hackney, England

[73] Assignee: Eastman Kodak Company, Rochester, N.Y.

[21] Appl. No.: 613,515

[22] PCT Filed: Apr. 13, 1990

[86] PCT No.: PCT/EP90/00607

§ 371 Date: Nov. 5, 1990

§ 102(e) Date: Nov. 5, 1990

[87] PCT Pub. No.: WO90/13060

PCT Pub. Date: Nov. 1, 1990

[30] Foreign Application Priority Data

Apr. 26, 1989 [GB] United Kingdom ..... 8909578

[51] Int. Cl.[5] ..... G03C 5/38

[52] U.S. Cl. ..... 430/393; 430/414; 430/455

[58] Field of Search ..... 430/393, 399, 400, 430, 430/434, 455, 456, 457, 458, 459, 460, 464, 966, 414

[56] References Cited

U.S. PATENT DOCUMENTS

| | | | |
|---|---|---|---|
| 2,748,000 | 5/1956 | Mader | 430/460 |
| 3,252,797 | 5/1966 | Kazen | 430/456 |
| 3,282,695 | 1/1964 | Narodny | 96/61 |
| 3,674,490 | 7/1972 | Matejec | 96/48 |
| 3,843,673 | 10/1974 | Brown et al. | 430/460 |
| 4,113,490 | 9/1978 | Fujiwhara | 96/50 |
| 4,222,777 | 9/1980 | Nakajima et al. | 430/363 |

FOREIGN PATENT DOCUMENTS

| | | |
|---|---|---|
| 0207001 | 6/1986 | European Pat. Off. . |
| 1554123 | 3/1977 | United Kingdom . |

OTHER PUBLICATIONS

G. Haist, Modern Photographic Processing, pp. 598-599.

*Primary Examiner*—Hoa Van Le

*Attorney, Agent, or Firm*—Michael L. Goldman; Joshua G. Levitt; Robert L. Carlson

[57] ABSTRACT

A method of removing silver chloride from a photographic silver halide material during processing which comprises treatment with an aqueous fixing solution containing an alkali metal sulphite as sole silver halide solvent. to remove substantially all of silver chloride in less than 50 seconds.

7 Claims, 1 Drawing Sheet

METHOD OF PHOTOGRAPHIC PROCESSING

Figure 1:
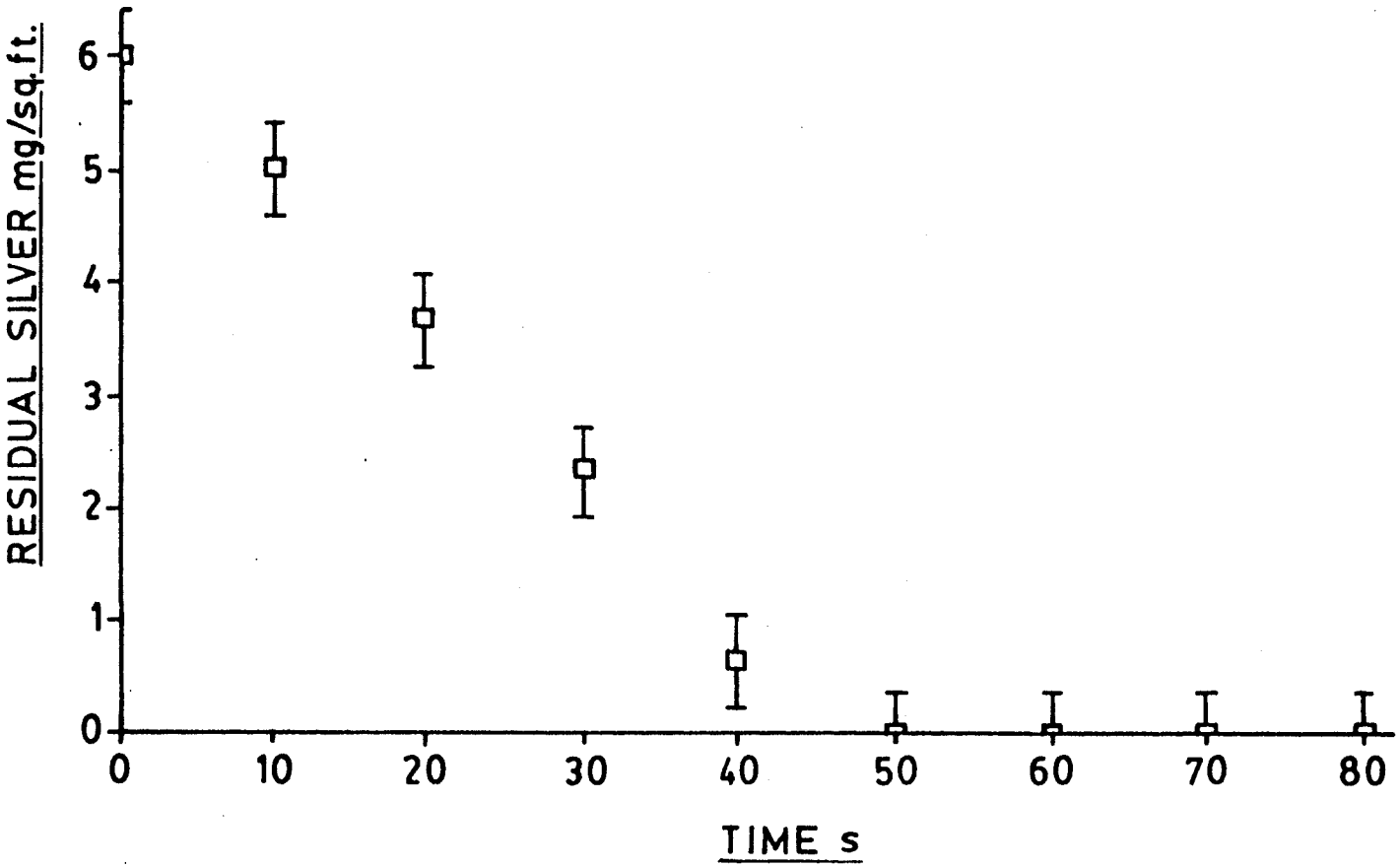

This invention relates to photographic processing and, in particular, to a method of fixing.

Photographic silver halide materials are employed to form images by first imagewise exposing the material, e.g. in a camera, and then processing to form a visible image. The processing steps usually include (a) a development step in which the exposed areas of the material form a visible image and (b) a fixing step whereby the undeveloped silver halide is removed by treatment with a fixer solution which contains a silver halide solvent.

It is known that a number of compounds can be used as the silver halide solvent. These include sulphites and thiosulphates. Although it is known that sulphites have silver halide solvent activity, they have only been used in fixer solutions in combination with another silver halide solvent, e.g. thiosulphates and for the purpose of stabilising such solutions against sulphur precipitation. Sulphites have never been used alone as fixing agents in conventional photography due to the inordinately long time that would be needed to fix a typical photographic material. In practice it is the alkali metal or ammonium thiosulphates that have been exclusively used in commercially used processing solutions.

Thiosulphates however do have problems associated with their ease of safe disposal. In addition, under certain conditions some color couplers (as used in color materials) can continue to couple in a fixer (not a bleach fix) directly following a developer. Further, thiosulphate fixer solutions are unstable and can precipitate sulphur.

We have now found that alkali metal sulphite solutions can be employed to remove silver chloride from photographic materials in acceptable processing times.

According to the present invention there is provided a method of removing silver chloride from a photographic silver halide material during processing which comprises treatment with an aqueous solution containing an alkali metal sulphite as sole silver halide solvent. The solution will, of course, be essentially free of silver halide solvents other than alkali metal sulphites.

The present sulphite fixers, compared to existing thiosulphate fixers, are less environmentally harmful in that they have a lower biological and chemical oxygen demand; they do not precipitate sulphur; and they produce a relatively harmless sulphate on oxidation. Sulphites are inexpensive and readily avaliable and they do not allow continued coupling of a color coupler in the fixer.

The silver chloride removed in the present process may be the undeveloped portions of the silver halide layer(s) of photographic materials in which the silver halide is substantially pure silver chloride. Such materials preferably contain less than 10% other halides. Alternatively silver formed by development earlier in the process may be bleached to form silver chloride and then removed by the present method. In such a case which might arise in, for example reversal processing, the photographic material may have originally comprised halides other than chloride.

The alkali metal sulphite may be employed in a wide range of concentrations, for example at 5–200 g/litre (as anhydrous sodium sulphite); preferred solutions contain 10–150 g/liter.

Unlike conventional fixing solutions which are acid, the sulphite solutions, preferably have an alkaline pH, particularly a pH greater than 6. Additional pH-controlling compounds may be employed to achieve the higher or lower pH values within this range.

The present method is particularly suitable for silver chloride materials having total silver coating weights of from 1 mg–10 g/m$^2$, the lower end of the scale being preferred, especially from 1 mg–1 g/m$^2$. Clearly the less silver chloride contained in the material, the faster will be the fixing times.

The present method is suitable for both black-and-white and color materials. The silver halide emulsions may be negative-working (including those intended for reversal processing) or direct-positive. Their silver halide grains may be of any shape or dispersity. For example the grains may be cubic, octahedral or tabular and the emulsions may be monodisperse or polydisperse. Color materials will contain, in or adjacent the silver halide layers, color couplers which form image dye on reaction with oxidised color developer.

Typically, the couplers are associated with silver halide emulsion layers coated on a support to form a photographic material. As used herein, the term "associated with" signifies that the coupler is incorporated in the silver halide emulsion layer or in a layer adjacent thereto where, during processing, it is capable of reacting with silver halide development products.

Typically the coupler is dissolved in a coupler solvent and this solution is dispersed in an aqueous gelatin solution. Examples of coupler solvents that may be used are dibutyl phthalate, tricresyl phosphate, diethyl lauramide and 2,4-di-tertiary-amylphenol. In addition an auxilliary coupler solvent may also be used, for example ethyl acetate, cyclohexanone, and 2-(2-butoxy-ethoxy)ethyl acetate, which are removed from the dispersion before incorporation into the photographic material.

The photographic materials can be single color materials or multicolor materials. In a multicolor material, the yellow dye-forming couplers would usually be associated with a blue-sensitive emulsion, although they could be associated with an emulsion sensitised to a different region of the spectrum, or with a panchromatically sensitised, orthochromatically sensitised or unsensitised emulsion. Multicolor materials contain dye image-forming units sensitive to each of the three primary regions of the spectrum. Each unit can be comprised of a single emulsion layer or of multiple emulsion layers sensitive to a given region of the spectrum. The layers of the materials, including the layers of the image-forming units, can be arranged in various orders as known in the art.

A typical multicolor photographic material comprises a support bearing a yellow dye image-forming unit comprised of at least one blue-sensitive silver halide emulsion layer having associated therewith at least one yellow dye-forming coupler and magenta and cyan dye image-forming units comprising at least one green- or red-sensitive silver halide emulsion layer having associated therewith at least one magenta or cyan dye-forming coupler respectively. The material can contain additional layers, such as filter layers.

In the following discussion of suitable materials for use in the emulsions and materials of this invention, reference will be made to Research Disclosure, December 1978, Item 17643, published by Industrial Opportunities Ltd., The Old Harbourmaster's, 8 North Street, Emsworth, Hants PO10 7DD, U. K. This publication will be identified hereafter as "Research Disclosure".

The silver halide emulsion employed in the materials of this invention can be either negative-working or positive-working. Suitable emulsions and their preparation are described in Research Disclosure Sections I and II and the publications cited therein. Suitable vehicles for the emulsion layers and other layers of materials of this invention are described in Research Disclosure Section IX and the publications cited therein.

In addition to couplers, the photographic materials to be processed can include additional couplers as described in Research Disclosure Section VII, paragraphs D, E, F and G and the publications cited therein. Couplers can be incorporated in the materials and emulsions as described in Research Disclosures of Section VII, paragraph C and the publications cited therein.

The photographic materials or individual layers thereof, can contain brighteners (see Research Disclosure Section V), antifoggants and stabilisers (see Research Disclosure Section VI), antistain agents and image dye stabiliser (see Research Disclosure Section VII, paragraphs I and J), light absorbing and scattering materials (see Research Disclosure Section VIII), hardeners (see Research Disclosure Section XII, plasticisers and lubricants (see Research Disclosure Section XIII), matting agents (see Research Disclosure Section XVI) and development modifiers (see Research Disclosure Section XXI).

The photographic materials can be coated on a variety of supports as described in Research Disclosure Section XVII and the references described therein.

Photographic materials can be exposed to actinic radiation, typically in the visible region of the spectrum, to form a latent image as described in Research Disclosure Section XVIII and then developed to form a visible dye image as described in Research Disclosure Section XIX. With negative-working silver halide emulsions this processing step leads to a negative image. To obtain a positive (or reversal) image, this step can be preceded by development with a non-chromagenic developing agent to develop exposed silver halide, but not form dye, and then uniform fogging of the materials to render unexposed silver halide developable. Alternatively, a direct positive emulsion can be employed to obtain a positive image.

Other parts of the present processing method may comprise use of a developer, fogging developer, color developer, stop bath, bleach, bleach-fix or stabiliser solutions. The processing may be done by hand or in a processing machine. Typical processing temperatures range from 10° to 50° C.

In a particularly preferred embodiment the photographic material is processed using a redox amplifying color developer bath. For example as described in U.S. Pat. Nos. 3,765,891, 3,674,490, 3,765,890, 3,765,891, 3,817,751, 4,057,429 and 4,745,043, and in British Patents 1,268,126, 1,339,481, 1,403,418 and 1,560,572. Materials designed for such a process need only very low amounts of silver halide, e.g. less than 10 mg/m$^2$ total silver.

The following example is given for a better understanding of the invention.

EXAMPLE 1

A color paper of similar construction to known commercial color papers comprising all silver chloride emulsions was made with the typical dispersion and gel laydowns except that the silver coating weight was reduced to 11 mg/m$^2$ in the red sensitive layer, 11 mg/m$^2$ in the green sensitive layer and 44 mg/m$^2$ in the blue sensitive layer, giving a total silver laydown of 66 mg/m$^2$.

Samples of this coating were swollen in a 25 g/liter potassium carbonate buffer pH 10.1 to simulate the developer. These were then plunged into the experimental fixer (25° C.) and processed for varying times. The strips were then washed for 2 minutes (25°) and then treated with 5 g/liter sodium sulphide solution to reveal any residual silver. The samples were then washed for a further 2 minutes, then hung up to dry. The reflection blue density of each strip was measured. It was found that the maximum density for the unfixed product was 0.28 and for a totally fixed product the density was 0.06. Atomic absorption showed that there was a good linear correlation between blue density and residual silver.

A fixer containing 20 g/liter sodium sulphite (pH 9.0) was tested. The residual silver versus time curve is shown as FIG. 1. As can be seen, fixing is complete in less than 50 seconds.

The following table shows the estimated fixing times for different sodium sulphite concentrations:

| [$Na_2SO_3$] g/l | Fixing Time (seconds) |
|---|---|
| 20 | 45 ± 5 |
| 40 | 25 ± 5 |
| 60 | 15 ± 5 |

I claim:

1. A method for processing color photographic material, comprising:

imagewise exposing a color photographic material comprising a substantially pure silver chloride emulsion having a total silver coating weight of from 0.001–1.0 gm/m$^2$ to form an image;

forming a color image using redox amplification; and removing unexposed and undeveloped silver chloride from the photographic material by fixing said material in an aqueous solution containing a concentration of from 5–200 g/l of an alkali metal sulphite as a sole silver halide solvent, said alkali metal sulphite concentration being sufficient to remove substantially all of said silver chloride in less than 50 seconds.

2. A method is claimed in claim 1, wherein the silver chloride has been formed by bleaching silver with a silver chloride forming bleach solution.

3. A method as claimed in claim 1, wherein the aqueous solution contains from 10 to 150 grams of anhydrous sodium sulphite per liter of solution.

4. A method as claimed in claim 2, wherein the aqueous solution contains from 10 to 150 grams of anhydrous sodium sulphite per liter of solution.

5. A method as claimed in claim 1, wherein the aqueous solution contains from 10 to 150 grams of anhydrous sodium sulphite per liter of solution.

6. A method as claimed in claim 1, wherein the aqueous solution contains from 10 to 150 grams of anhydrous sodium sulphite per liter of solution.

7. A method as claimed in any of the above claims wherein the aqueous solution has a pH greater than 6.

* * * * *